US005153168A

United States Patent [19]

Uhlemayr et al.

[11] Patent Number: 5,153,168

[45] Date of Patent: Oct. 6, 1992

[54] SELF-DUPLICATING PAPER PRODUCT

[75] Inventors: Reinhold Uhlemayr; Rolf Waible, both of Rutesheim, Fed. Rep. of Germany

[73] Assignee: Drwaxher Geschaftsdrucke GmbH, Fed. Rep. of Germany

[21] Appl. No.: 828,372

[22] Filed: Jan. 30, 1992

[30] Foreign Application Priority Data

Feb. 23, 1991 [DE] Fed. Rep. of Germany ..... 4105767

[51] Int. Cl.[5] ..... B41M 5/128

[52] U.S. Cl. ..... 503/206; 427/152; 503/226

[58] Field of Search ..... 503/206, 226; 427/152

[56] References Cited

U.S. PATENT DOCUMENTS 3,906,123 9/1975 Vincent et al. ..... 427/150

FOREIGN PATENT DOCUMENTS 3706491 9/1987 Fed. Rep. of Germany .

8403663 9/1984 PCT Int'l Appl. .

OTHER PUBLICATIONS

"Die Bedruckbarkeit von selbstdurchschreibenden Papieren in Bogen und Rolle", *Der Polygraph,* pp. 1167-1169, 1978.

"UV-Tronic Information", SICPA Druckfarben GmbH, Aug., 1991.

*Primary Examiner*—Pamela R. Schwartz

*Attorney, Agent, or Firm*—Edward J. Timmer

[57] ABSTRACT

In order, in a self-duplicating paper product, to block certain areas in their duplicating function, it is suggested that these particular areas of at least one paper surface bearing one of the two reaction components be coated with a barrier layer not permeable to the reaction components, whereby the barrier layer material leaves the reactivity of the reaction components as such essentially unaffected.

9 Claims, 1 Drawing Sheet

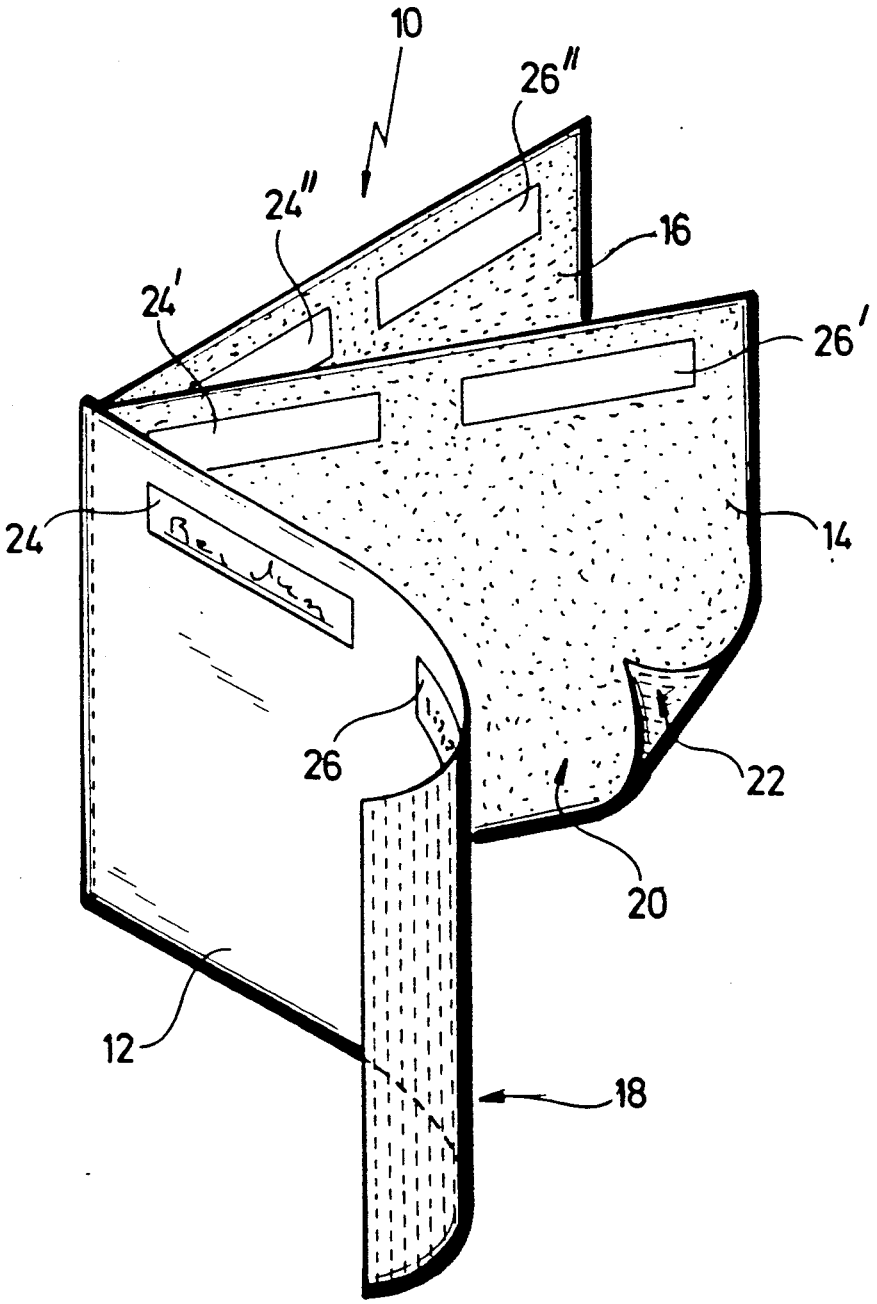
10
26''
24''
16
24'
26'
24
14
26
22
20
12
18

SELF-DUPLICATING PAPER PRODUCT

The invention relates to a self-duplicating paper product comprising two reaction components applied to separate paper surfaces, wherein these components can be brought into contact with one another only by pressure. Normally at least one of the reaction components, namely the color former, is present in a form dissolved in microcapsules which are destroyed during writing and thereby release the color former for the color reaction. When brought into contact the color former and the other reaction component undergo a chemical reaction developing the desired color.

In many cases of application, for example in the fields of payment transactions and data protection, information is not written through in one or more areas, not only in the case of self-duplicating paper but also quite generally for sets of carboned paper, since these areas contain information which is not intended to be brought to the attention of every recipient of one of the copies.

When using carbon paper as intermediate layers between the individual sheets of paper, the areas containing the data to be kept secret are left out so that this information is not written through or only onto the copies which are sent to a recipient for whom this information is intended.

In the case of the self-duplicating papers which offer many advantages in comparison with sets of paper having carbon paper inserted, a defined region could, in principle, be excluded, for example, from the coating with color formers (cf. e.g. DE 37 06 491 C 2). However, this would entail a printing process with the corresponding reaction component instead of the continuous coating of the paper which is generally carried out nowadays.

In order to provide the possibility of also using self-duplicating paper in cases, in which certain data may not appear on all the copies or duplicates, the method used previously was to print the selected regions, which are not to be copied and contain the color former, with a so-called neutralizing paste which modifies the color former such that it is no longer capable of reacting with the second reaction component. This method is described, for example, in "Der Polygraph" 15-78, pages 1167 to 1169 with its possibilities of use and problems.

This solution is now in widespread use for self-duplicating papers despite the deficiencies which this method has.

On the one hand, it is easy for a person skilled in the art, who has some knowledge of the chemistry of self-duplicating papers, to make visible the data and information which is not visible for the layman and, on the other hand, it happens again and again that the neutralizing paste is inadvertently applied during printing, due to smearing and soiling of the printer, to regions which should be available for the normal duplicating procedure.

In addition, the method of using a so-called neutralizing paste is complicated since this has to be adapted each time in its reactivity to the color forming system used. Moreover, the neutralizing pastes represent a considerable cost factor.

Furthermore, specific regions of the self-duplicating papers are lately being provided to an increased extent for the inclusion of bar codes or OCR lettering, i.e. generally for marking with machine readable data, and in these regions it must be ensured, in order to guarantee as low an error rate as possible during mechanical data gathering, that no color reaction can take place.

Particularly for the printing of conventional neutralized surfaces with bar codes or OCR characters, difficulties may occur in marking or reading as a result of the neutralizing paste applied.

An uneven application of the neutralizing paste can already lead to the formation of color spots during use of the papers and these spots can reduce the contrast necessary for optical data gathering so considerably that it is no longer possible to ensure correct recording of the machine readable data.

In addition, it is observed again and again that the reaction components applied with the neutralizing paste migrate into adjacent regions, for example into the layers of paper located above or below, particularly when the paper is stored for a longer period, and so this results in an undesired manner in a reduced duplicating capability.

The object of the present invention is to provide self-duplicating papers having areas protected for the copy, in which the problems discussed above are avoided.

This object is accomplished in accordance with the invention, for a self-duplicating paper product of the type described at the outset, in that parts of paper surfaces bearing at least one of the two reaction components are coated with a barrier layer no longer permeable to the reaction components, the barrier layer leaving the reactivity of the reaction components as such essentially unaffected.

These barrier layers may be applied to certain regions very simply during the printing process. Since the only prerequisite is that the barrier layer does not allow the two reaction components to pass through to one another, a broad scope of barrier layer materials can be considered. The barrier layer is preferably used in the form of a lacquer, in particular as already used for increasing the reproduction of color brilliance in multicolor printing. These lacquers often contain UV hardenable polymers. The UV hardenability, or rather the UV drying, has the advantage that a chemical drying can be achieved within fractions of a second and that the layer lying underneath is already screened completely. There is also no risk to the dimensional stability which is very important, especially, in the field of self-duplicating papers for payment transactions.

Due to the fact that the reactivity of the reaction components remains essentially unaffected by the barrier layer material, no reduction in the duplicating capability will occur even if residues of the barrier layer material inadvertently pass into certain areas, the duplicating capability of which is intended to be kept.

It is not only possible to cover the areas which are coated with color former, the so-called CB layers, with the barrier layer but it is also just as possible to cover the second reaction component normally applied to the front sides of the self-duplicating papers with the barrier layer and thereby prevent any reaction taking place between the two reaction components during use of the self-duplicating sets. It is, of course, possible, in certain uses, for the two reaction components to be covered by separate barrier layers.

In order to make the broad scope of use which is possible with the invention more evident, several examples of its use will be specified in the following, whereby the abbreviation CB will be used in the following for reaction components applied to the reverse side, in particular the color former which is present in a core solvent encapsulated in microcapsules, and the abbreviation CF for the reaction component applied to the front of the paper layers, which is not generally enclosed in capsules.

In accordance with the methods previously known, it is only possible to block the area which contains the color former for the color reaction, whereas, according to the inventive procedure, and adapted to the respective purpose, either the CB or the CF area, i.e. the color former or its reaction component, can be covered. The effect is, first of all, the same in both cases, namely no color reaction takes place in these areas. Proceeding on this basis, it is possible to find new types of application which will be explained in more detail in the following:

Parts of the Surface of the CB Coating are Covered with a Barrier Layer

The CF layer remains accessible over its entire surface. However, the duplicating effect results only in the areas in which both the CB and the CF layers are available for the color reaction.

In the case of this embodiment, the information printed in the partial areas cannot subsequently be made identifiable with a CB reaction agent since, in this case, the entire surface, onto which the CB reaction agent would be placed, would lead to the color reaction.

Partial Covering of the CF Layer with a Barrier Layer

This alternative can be selected when, in certain circumstances, it is necessary to make visible at a later date the information which is, first of all, not visible in the partial areas. In this case, spraying the CB layer with the CF reaction component would make the lettering or information distinguishable.

Covering the CB and the CF Layers with a Barrier Layer in Certain Regions

This results in a duplicating set, in which the areas covered with the barrier layer are not accessible to any chemical manipulation whatsoever, in particular when care is taken that the barrier or lacquer layers are more stable in their behaviour with respect to solvents than the walls of the microcapsules.

The covering of the CF and/or CB layers can also be used for those panels on the duplicating sets in which no information is normally inserted. The application of the barrier layer has the purpose of keeping these panels free from any optical alterations as these panels are used for writing in machine readable data. This is of particular interest for the application of bar codes and in the widespread use of document reading procedures, for example in payment transactions.

The present invention avoids, in particular, the possibility of chemical components migrating which could reduce the color reaction in the areas still suitable for writing on, and, in particular, the invention can be used for producing copy documents which are absolutely safe against manipulation.

The invention offers, in addition, great advantages when using duplicating forms in payment transactions, in which the methods of reading documents by machines have gained great importance. However, this leads to great progress in the way of rationalization only when it is ensured that the majority of the documents to be read are not altered and impaired in their readability by normal handling of these documents.

The invention will now be explained in greater detail on the basis of examples and the drawing:

Conventional, self-duplicating papers of the CB, CF and CFB types were used for the tests described in the following.

The results of these tests can be summarized by ascertaining that a special adjustment of the barrier layer to the compatibility of the individual papers is not required. This means that with the same barrier layer material different sorts of paper, in particular papers having varying color forming systems, can be processed.

The UV lacquers described in the following as barrier layer materials can be applied by any printing process and hardened by conventional UV driers.

These conventional UV lacquers are based on a preparation consisting of monoacrylates and polyacrylates of polyols, modified acrylates, organic photoinitiators as well as customary aids, such as, for example, surfactants.

The coating weight with the barrier layer lacquers was varied in the range of 6 to 12 g/m$^2$, the best results being achieved at a coating weight of approximately 10 g/m$^2$.

The tests were related to the application of barrier layers to the CF, CB as well as to the front and rear sides of CFB papers.

EXAMPLE 1

A conventional CF paper was printed by wet offset printing with approximately 10 g/m$^2$ UV lacquer in certain regions, whereby the lacquers obtainable under the trade names SICPA UV overprint lacquer 806181 as well as SICPA UV glossy lacquer 806182 could be used in like manner.

The paper was dried in a conventional UV drier.

During the duplicating test, no traces of lettering whatsoever could be found in the printed area, i.e. the barrier layer reliably separates the two reaction components from one another.

EXAMPLE 2

A conventional CB paper was also printed by wet offset printing with 10 g/m$^2$ UV lacquer, whereby lacquers were again used which can be obtained under the trade names SICPA UV overprint lacquer 806181 as well as the type SICPA UV glossy lacquer 806182.

The drying was done as in Example 1.

The duplicating test showed that the particular regions of the CB paper printed with the UV lacquer generated no traces of writing, and, in this case, care is taken due to the effect of the barrier layer on the side of the encapsulated dye precursors that it is not possible to make the trace of writing visible subsequently.

EXAMPLE 3

A conventional CFB paper was printed by wet offset printing with 10 g/m$^2$ UV lacquer in particular areas, whereby, again, the SICPA UV overprint lacquer 806181 and the SICPA UV glossy lacquer 806182 were used.

The drying took place as in Example 1.

With the papers thus obtained, the duplicating test again shows no traces of writing whatsoever on the protected copies and these papers are in any case protected so that no manipulation of any kind can lead to the traces of writing becoming visible.

BRIEF DESCRIPTION OF THE DRAWINGS

The drawing shows a schematic illustration of a set of forms designated altogether as 10. This set of forms comprises, apart from a top sheet 12, a center sheet 14 and a last sheet 16.

The top sheet 12 bears on its reverse side 18 a so-called CB coating which comprises a color former dissolved in a core solvent and enclosed in microcapsules.

The color former or dye precursor is generally the leuco form of a dye and forms a first reaction component.

The center sheet 14 bears on its front side 20 a so-called CF coating which contains a component which is capable of converting the leuco dye into the dye form.

The reverse side 22 of the center sheet 14 again bears a so-called CB coating which, with respect to its composition, is identical to the coating on the reverse side 18 of the top sheet 12.

The coating on the front side of the last sheet 16 corresponds again to the coating on the front side of the center sheet 14. When information is written or printed on the top sheet 12 this information is passed through to the center and last sheets 16 due to interaction of the encapsulated dye precursors with the reaction component of the CF coating since, due to the pressure exerted when writing the information, the microcapsules shatter along the line of writing and release the dye precursor and this reacts with the second reaction component of the CF coating.

In the set of forms 10 of the drawing, two separate areas 24, 26 are indicated, in which information is contained or placed which is not to be written through onto the center and last sheets.

The panels 24', 26', 24'' and 26'' corresponding hereto are coated in accordance with the invention with a barrier layer, in the present case on each of the front sides. In this case, the core solvent with the dye precursor which exits from the capsules is prevented from coming into contact with the second reaction component which is present in the CF coating on the sheets 14 and 16.

It would, of course, also be possible to cover the corresponding area 24 on the reverse side with a barrier layer so that the core solvent with the dye precursor cannot come into contact at all with the upper side 20 of the center sheet 14 or with the upper side of the last sheet 16.

In addition, it is, of course, possible to prevent any writing through onto the center sheet and allow the information to appear again on the last sheet by dispensing with the barrier layer in this case.

It is important for the present invention to ensure via a barrier layer that the two reaction components are prevented from meeting during writing without the actual reactivity of the components hereby being reduced. This has the particular advantage that in the case where remnants of the barrier layer, or rather the barrier layer material, are left in the printing rollers and these portions then carried on into areas which are actually intended to be available for writing through information, this does not lead to a reduction in or to a loss of duplicating capabilities.

On the one hand, this allows very exactly defined areas to be achieved, in which no writing through takes place, and, on the other hand, prevents the undesired effect that the duplicating capability of the paper is unintentionally diminished in other areas where this is not desired.

In the case where the barrier layer is applied to the front of the center and last sheets or on the side of the sheet on which the second reaction component complementary to the dye precursor is applied, the trace of writing can subsequently be made visible on the reverse side in that the second reaction component is applied to the microcapsules shattered along the writing line.

If this is to be prevented, it is recommended that either an additional barrier layer be applied to the coating containing the microcapsules or these alone be coated.

A complete fade-out of information is obtained with the double-sided coating of the areas to be protected and, in addition, the certainty that the duplicated information cannot be made visible at a later date by manipulation and thereby perhaps fall into the wrong hands.

We claim:

1. Self-duplicating paper product comprising two reaction components applied to separate paper surfaces, these components being brought into contact with one another only by pressure, certain regions of at least one paper surface bearing one of the two reaction components being coated with a barrier layer not permeable to the reaction components, the barrier layer material leaving the reactivity of the reaction components as such essentially unaffected and preventing the two reaction components from meeting from application of pressure during writing to said region.

2. Paper product as defined in claim 1, wherein the barrier layer is a lacquer.

3. Paper product as defined in claim 1, wherein the barrier layer comprises a UV hardenable polymer.

4. Paper product as defined in claim 1, wherein parts of the reaction component applied to the front side are coated with a barrier layer.

5. Paper product as defined in claim 1, wherein parts of the reaction component applied to the reverse side are coated with a barrier layer.

6. Paper product as defined in claim 1, wherein at least one of the reaction components is applied to the paper surface in the form of microcapsules and that the barrier layer has a greater resistance to solvent than the walls of the microcapsules.

7. Paper product as defined in claim 1, wherein at least one of the regions of the paper surface coated with a barrier layer has machine readable data printed thereon.

8. Paper product as defined in claim 1, wherein the barrier layer is UV absorbent.

9. Paper product as defined in claim 1, wherein the barrier layer is essentially composed of a mixed polyacryl-polyester polymer.

* * * * *

UNITED STATES PATENT AND TRADEMARK OFFICE

CERTIFICATE OF CORRECTION

PATENT NO. : 5 153 168

DATED : October 6, 1992

INVENTOR(S) : Reinhold UHLEMAYR, et al

It is certified that error appears in the above-identified patent and that said Letters Patent is hereby corrected as shown below:

On the title page, item [73] Assignee:

replace "Drwaxher Geschaftsdrucke GmbH" with

---Drescher Geschäftsdrucke GmbH---.

Signed and Sealed this

Tenth Day of May, 1994

*Attest:*

*Attesting Officer*

BRUCE LEHMAN

*Commissioner of Patents and Trademarks*